United States Patent [19]

Helfman

[11] 4,439,959

[45] Apr. 3, 1984

[54] RESIDENTIAL BUILDING CONSTRUCTION

[76] Inventor: Robert Helfman, 6682 Edgewood, Brighton, Mich. 48116

[21] Appl. No.: 254,535

[22] Filed: Apr. 15, 1981

[51] Int. Cl.[3] ..... E04H 1/00

[52] U.S. Cl. ..... 52/90; 52/169.1; 52/204; 52/236.3

[58] Field of Search ..... 52/236.3, 303, 404, 52/90, 169.1

[56] References Cited

U.S. PATENT DOCUMENTS

| | | | |
|---|---|---|---|
| 2,348,180 | 5/1944 | Paley | 52/90 |
| 2,477,152 | 7/1949 | Stevenson | 52/303 |
| 4,041,661 | 8/1977 | Hurwitz | 52/204 |
| 4,320,604 | 3/1982 | O'Hanlon | 52/204 |
| 4,334,393 | 6/1982 | U'Ren | 52/169.6 |

FOREIGN PATENT DOCUMENTS

| | | | |
|---|---|---|---|
| 848562 | 7/1952 | Fed. Rep. of Germany | 52/90 |
| 352813 | 4/1961 | Switzerland | 52/90 |

OTHER PUBLICATIONS

Popular Mechanics, Sep. 1951, pp. 180–185 (184 specifically).

Garlinghouse Publication, *All American Homes*, pp. 55 and 58.

*Primary Examiner*—John E. Murtagh

*Attorney, Agent, or Firm*—Gifford, VanOphem, Sheridan, Sprinkle & Nabozny

[57] ABSTRACT

A residential building construction comprising four interconnected foundation walls which are partially sunk below a ground surface and support the floor across their upper end. Two side walls, a front wall and a back wall are supported by and extended upwardly from the foundation walls while a roof extends across and covers the side walls, back wall and front wall. A first interior wall extends between the floor and the roof at a position spaced inwardly but parallel to the front wall while, similarly, a second interior wall extends between the floor and roof at a position spaced inwardly but parallel to the back wall. The interior walls together with the building side walls form a living space of conventional height. In addition, the housing front wall preferably includes two windows having portions extending both above and below the housing floor. These windows provide illumination for the lower living level and, simultaneously, give the building construction the appearance of a conventional ranch home.

6 Claims, 2 Drawing Figures

RESIDENTIAL BUILDING CONSTRUCTION

BACKGROUND OF THE INVENTION

I. Field of the Invention

The present invention relates generally to building constructions and, more particularly, to a residential building construction.

II. Description of the Prior Art

The cost of residential buildings and specifically single dwelling detached homes has increased dramatically in recent times due to a number of different factors, including increased material costs, labor costs and the like. The overall cost of homes has been further increased by prolonged high interest rates which in turn result in high mortgage rates. Consequently, the previously known conventional single dwelling detached homes has become prohibitly expensive for many, if not most, families.

One reason for the high cost of single family detached homes is that the previously known home construction have made only inefficient utilization of the available floor space for the home. In particular, the previously known homes have not made efficient use of the attic space of the home, i.e., the space between the home roof and the ceiling of the top floor of the home.

A still further disadvantage of the previously known home construction is that all of the building walls, both exterior and interior, are conventionally constructed and then erected at the building site and with little or no prefabrication of the building structure. Such complete construction of the home at the building site, however, is not only expensive in labor costs since the construction is much more time-consuming than it would be with prefabricated portions of the home, but is also dependent upon external factors, such as the weather.

Home designs are available which provide a more efficient use of the available floor space but many home purchasers are reluctant by human nature to purchase contemporary or unfamiliar home designs. For this reason, builders have continued to erect homes of conventional design despite their inefficient use of the floor space, inefficient construction and resulting high cost.

SUMMARY OF THE PRESENT INVENTION

The present invention overcomes all of the above mentioned disadvantages of the previously known homes by providing an inexpensive single family dwelling which can be constructed in part from prefabricated trusses, which makes efficient use of the available floor home space and which has the exterior appearance of a conventional ranch home.

In brief, the residential building construction or home according to the present invention comprises a lower living space bounded by four interconnected and generally vertically extending foundation walls which are generally rectangular in shape when viewed from the top. These foundation walls are partially sunk below the ground surface so that at approximately half of the foundation walls extend above the ground while the other half extend below the ground. Preferably, these foundation walls are constructed from two by six wooden studs to provide ample space between the studs for insulation. Such studs must also be waterproofed in order to resist moisture from the ground.

A rectangular floor is disposed across and supported at the upper end of the foundation walls so that the floor is spaced upwardly from the ground surface. In addition, interconnected side walls, a front wall and a back wall extend upwardly from the floor so that each side wall, back wall and front wall is aligned with one of the foundation walls. A rectangular pitched roof then extends across and covers the upper ends of the side walls, front wall and back wall.

An interior wall extends between the floor and the roof at a position spaced inwardly from but parallel to the front wall. Likewise, a second interior wall extends between the floor and the roof at a position spaced inwardly from but parallel to the back wall of the housing. The area bounded by the two interior walls together with the side walls form an upper living space of conventional height. A ceiling extends above this upper living space and intersects the building roof between the interior walls so that an attic of only negligible size is formed between the ceiling and the building roof.

In the preferred form of the invention, at least one and preferably two conventional windows are provided on the front wall of the housing. Each window has portions extending both above and below the level of the floor and serve a two-fold purpose. First, the lower half of each window provides illumination for the lower living space of the home. Secondly, the windows give the exterior appearance to the home of a conventional ranch house.

In the preferred form of the invention, the housing frame is constructed from prefabricated trusses which, together, form the frame work for both the floor, interior walls, upper exterior walls and the roof of the housing. These trusses, furthermore, are substantially identical to each other in construction and can be conveniently, efficiently and economically produced at a factory and then moved in their assembled form to the building site. By the use of the prefabricated truss, the construction time required to erect the home at the building site is greatly reduced as compared with the construction time for the previously known homes.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
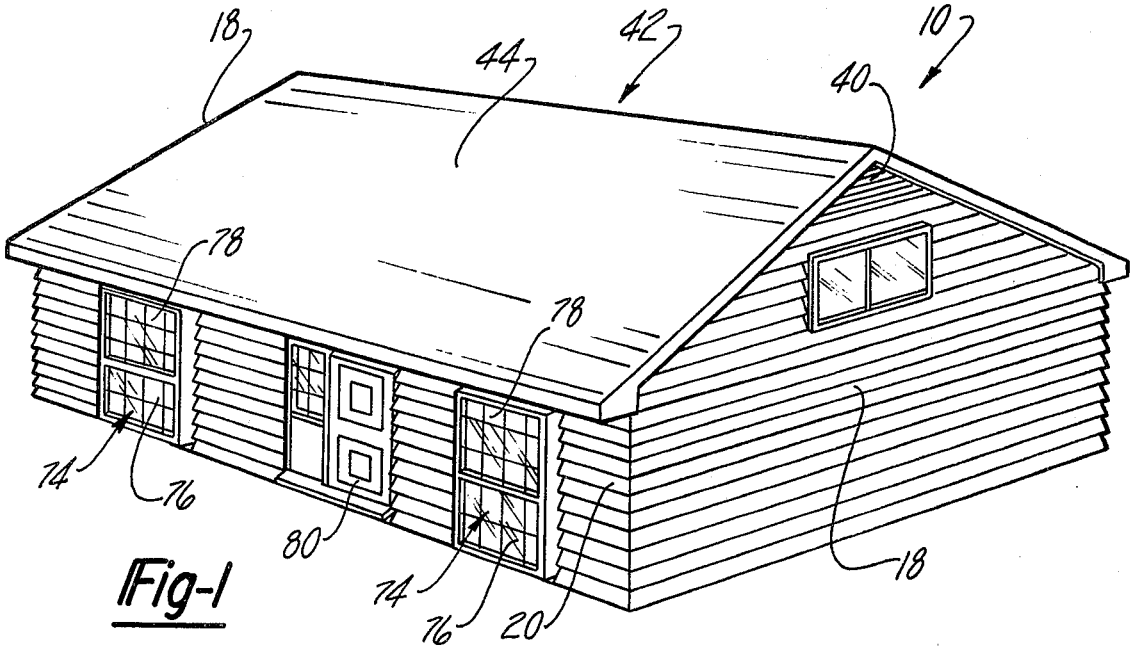
FIG. 1 is a front elevational view illustrating a preferred embodiment of the invention.

With reference to the drawing, a preferred embodiment of the residential building construction or home 10 is thereshown erected on a building site having a ground surface level 12. The home 10 comprises a rectangular concrete slab 14 which lies in a horizontal plane. In addition, the concrete slab 14 forms the lowermost floor for the home 10 and is sunk below the ground surface 12 by approximately one-half the height of a conventional home living space. Since the height of a conventional home living space is anywhere seven to nine feet, the slab 14 is sunk approximately three and one-half or four feet below the ground level.

Four vertically extending foundation walls 16 are arranged around the perimeter of the slab 14 and the foundation walls 16 are interconnected along their intersecting edges so that, when viewed from the top, these foundation walls 16 are generally rectangular in shape. Approximately one-half of each foundation wall 16 extends upwardly above the ground surface 12 while the other half extends below the ground level 12 and to the slab 14. The foundation walls 16 can be of any conventional construction but, in the preferred form of the invention, are constructed from two-inch by six-inch wooden studs having a length equal to the height of a conventional living space. The wooden studs, furthermore, are treated to improve their moisture resistance from the moisture in the ground and, conventional insulation (not shown) is disposed in between the studs of the foundation walls 16.

As will become hereinafter apparent, the area bounded by the foundation walls 16 forms a lower living space 72 of conventional height. Approximately one-half of the living space 72 extends above the ground level 12 while the other half extends downwardly into the ground.

A horizontal floor 30 is disposed across and supported by the upper ends 32 of the foundation walls 16 so that the floor 30 is spaced upwardly from the ground surface 12 by approximately one-half the height of a conventional living space. A pair of side walls 18, a front wall 20 and back wall 22 are then attached around the outer periphery and extend vertically upwardly from the floor 30. The side walls 18 are aligned with and extend upwardly from opposed foundation walls 16 while, similarly, the front wall 20 and back wall 22 are aligned with and extend upwardly from the other two opposed foundation walls 16.

The vertical height of both the front wall 20 and the back wall 22 is approximately one-half the height of a conventional living space or approximately four feet. Consequently, since the front and back walls 20 and 22 are one-half the height of a normal living space and the portion of the foundation wall 16 extending above the ground level 12 are also one-half the height of a normal living space, the home 10 has the exterior appearance and height of a conventional single story ranch house. Unlike the front and back walls, each side wall 18 has a roof peak 40 at its midpoint so that the upper portion of each side wall 18 is triangular in shape.

A rectangular roof 42 having two rectangular halves 44 and 46 is disposed over and closes the upward ends of the side walls 18, front wall 20 and back wall 22. Each roof half 44 declines downwardly from the roof peaks 40 thus forming eaves 48 and 50 which protrude outwardly from the front wall 20 and back wall 22, respectively.

Figure 2:
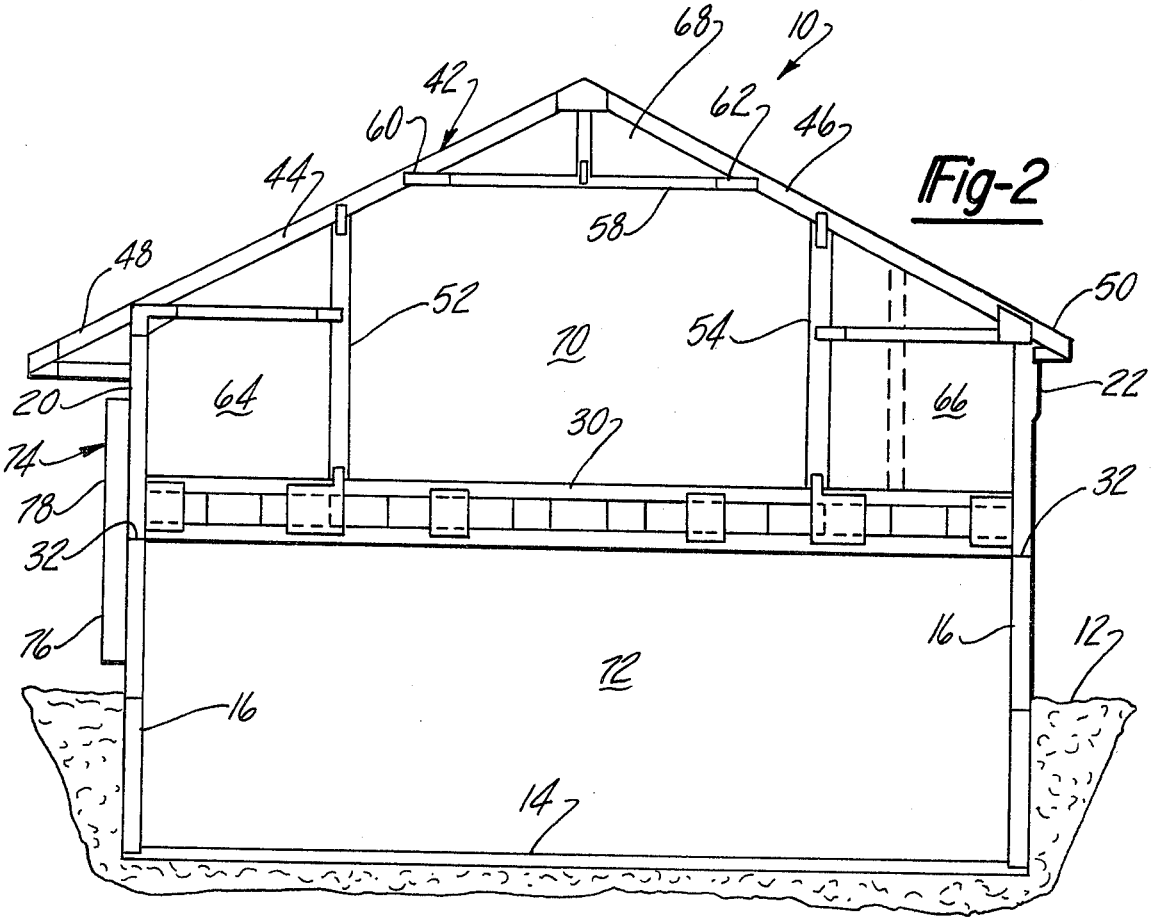
FIG. 2 is a sectional view taken substantially along line 2—2 in FIG. 1.

With reference now particularly to FIG. 2, a vertically extending interior wall 52 extends between the floor 30 and the roof 44 at a position spaced inwardly from but substantially parallel to the front wall 20. Similarly, a second interior wall 54 extends vertically from the floor 30 and to the roof 46 at a position spaced inwardly from but parallel to the rear wall 22.

A horizontal ceiling 58 is disposed across and secured to the roof 42 at 60 and 62 which are adjacent but slightly spaced inwardly from the interior walls 52 and 54. In addition, the ceiling 58 is secured to the roof 42 at a position so that the distance between the floor 30 and the ceiling 58 is the height of a conventional living space. Thus, the area bounded by the interior walls 52 and 54 and the side walls 18 together form a upper living space 70 of conventional height. Conversely, the areas 64 and 66 between the interior walls 52 and 54 and the front wall 20 and back wall 22 forms storage areas for the home. An attic 68 of only negligible size is formed between the ceiling 58 and the roof 42.

As thus far described, it can be seen that the home of the present invention provides the lower living level 72 which is partially sunk below the ground surface 12 as well as the upper living area 70 which utilizes space generally occupied by the attic in the previously known conventional homes. Furthermore, since the first living level 72 is partially sunk below the ground surface 12, the vertical height of the home as viewed from the outside is the same as a conventional one story house as has been previously described.

In order to further enhance the outer appearance of the home as a conventional one story ranch house at least one and preferably two vertically elongated windows 74 are attached to the front of the house so that the lower portion 76 of each window extends downwardly from the top of the front foundation wall 16 while the upper portion 78 of each window 74 extends upwardly across the front wall 20. In addition, the windows are spaced outwardly from the front of the housing (FIG. 2) to prevent interference between the windows and the upper housing trusses. This upper portion 78 of each window 74, however, is a false window and provides no illumination to the storage area 64.

The windows 74 serve a two-fold purpose. First, the windows 74 provide illumination through their lower portion 76 to the lower living level 72. Simultaneously, the window 74 gives an outward appearance that the home 10 is a conventional one-story ranch home thus overcoming the reluctance of home buyers to buy homes of unconventional design.

With reference particularly to FIG. 1, a door 80 is attached to the front of a housing at the ground level 12 while suitable steps (not shown) provide access from the door 80 to both the lower living levels 72 and upper living level 70. Interior walls (not shown)in both the lower living level 72 and upper living level 70 separate these living areas into conventional rooms, such as the kitchen, bedrooms, bathrooms and the like. These interior walls, however, are not illustrated in the drawing for the reason that any floor plan can be used while remaining within the scope and intent of the present invention.

With reference now to FIG. 2, the frame work for the floor 30, front wall 20, back wall 22, the roof 42 and interior walls 52 are preferably constructed from prefabricated trusses while are substantially identical to each other in construction. Consequently, the trusses necessary to form the frame work for the upper portion of the home 10 can be efficiently constructed at a factory and then transported in their assembled form to the building site. The use of prefabricated trusses simplifies the construction of the home at the building site and simultaneously minimizes the construction time necessary to erect the home.

From the foregoing, it can be seen that the present invention provides a home construction which can be rapidly constructed at relatively low cost. In addition, the home of the present invention provides approximately 50% more living space than a similar sized one-story ranch home while maintaining the outwardly appearance of a one-story ranch home. In order to still further reduce the initial cost of the home to the purchaser, if desired, the upper living level 70 can be initially left in an unfinished rough state while the family dwelling in the home uses only the lower living level 72.

When the additional room provided by the upper living level 70 is desired and/or affordable to the owner, the owner can then finish the upper living level 70.

A still further advantage of the home according to the present invention is that it is energy efficient and allows only a minimum of heat loss from the home. This energy efficiency is obtained primarily from the use of two-inch by six-inch wooden studs for the foundation walls 16 rather than two-inch by four-inch wooden studs, which enables a greater amount of insulation to be installed between the foundation studs. Furthermore, the earth which surrounds the lower half of the lower living level 72 itself acts as an insulating material thus making the home 10 even more energy efficient.

Having described my invention, however, many modifications thereto will become apparent to those skilled in the art to which it pertains without deviation from the spirit of the invention as defined by the scope of the appended claims.

I claim:

1. A residental building construction erected on a ground surface comprising:

four interconnected and generally vertically extending foundation walls, said foundation walls having a vertical length equal to the height of a conventional home living space and extending downwardly below the ground surface for substantially one-half of said height, said interconnected foundation walls being substantially rectangular in shape, a floor disposed across and supported by said foundation walls so that said floor is spaced upwardly from the ground surface by substantially one-half of said length, two side walls supported by and extending vertically upwardly from the opposed foundation walls and a front wall and a back wall supported by and extending vertically upwardly from the other two foundation walls, said side walls, back wall and front wall being interconnected together, said front and back wall having a height substantially equal to one-half said length, a roof having two substantially rectangular halves disposed across and supported by said side walls, back wall and front wall, so that said rectangular halves abut together along one edge and form a roof peak, said roof halves declining downwardly from said roof peak at an angle so that the vertical height of said building construction is substantially the same as a conventional one story house, at least one window secured to said front wall, said window having a bottom spaced below the floor and a top spaced above the floor so that said window spans across the floor and provides an outward appearance of a conventional one-story ranch for the building construction, said window comprising light transmissive panes extending continuously from its top and to its bottom, two interior walls extending vertically between said floor and said roof, one interior wall being spaced inwardly from but parallel to said front wall and the other interior wall being spaced inwardly from but parallel to said back wall, said interior walls and side walls together forming a living space of conventional height.

2. The building construction as defined in claim 1 and further comprising a ceiling above said living space, said ceiling intersecting and being attached to said roof closely adjacent but spaced inwardly from said interior walls.

3. The building construction as defined in claim 1 and further comprising at least two such windows on said front wall.

4. The building construction as defined in claim 1 wherein substantially one-half of said foundation walls extend below the ground surface.

5. The invention as defined in claim 1 wherein said foundation walls are constructed from wooden studs.

6. The invention as defined in claim 6 wherein said wooden studs are two inch by six inch moisture resistant treated wooden studs.

* * * * *

UNITED STATES PATENT AND TRADEMARK OFFICE

CERTIFICATE OF CORRECTION

PATENT NO. : 4,439,959

DATED : April 3, 1984

INVENTOR(S) : ROBERT HELFMAN

It is certified that error appears in the above—identified patent and that said Letters Patent is hereby corrected as shown below:

Column 3, line 66 delete "a" insert --an--.

Signed and Sealed this

*Second* Day of *April 1985*

[SEAL]

*Attest:*

DONALD J. QUIGG

*Attesting Officer* *Acting Commissioner of Patents and Trademarks*